United States Patent [19]

Weiss

[11] 3,973,547

[45] Aug. 10, 1976

[54] ENGINE CYLINDER BLOCK AND HEAD CONNECTION

[75] Inventor: Eckhard Weiss, Vaihingen, Germany

[73] Assignee: Daimler-Benz Aktiengesellschaft, Stuttgart, Germany

[22] Filed: Jan. 17, 1975

[21] Appl. No.: 541,951

[30] Foreign Application Priority Data

Jan. 24, 1974 Germany ..... 2403255

[52] U.S. Cl. ..... 123/193 CH; 123/41.83; 92/169

[51] Int. Cl.[2] ..... F02F 1/26

[58] Field of Search ..... 123/32 AA, 52 MC, 59 R, 123/193 CH, 193 H, 41.83, 41.84; 92/169

[56] References Cited

UNITED STATES PATENTS

| | | | |
|---|---|---|---|
| 1,127,783 | 2/1915 | Leimer | 123/41.84 |
| 3,483,856 | 12/1969 | Lovestrand | 123/193 H |
| 3,685,399 | 8/1972 | Hoch | 123/193 CH X |

FOREIGN PATENTS OR APPLICATIONS

| | | | |
|---|---|---|---|
| 271,362 | 2/1940 | Italy | 123/41.83 |

*Primary Examiner*—Charles J. Myhre
*Assistant Examiner*—William C. Anderson
*Attorney, Agent, or Firm*—Craig & Antonelli

[57] ABSTRACT

A reciprocating piston engine with at least one working space that is radially delimited by a cylinder liner retained in a cylinder block, and with at least one cylinder head which is sealingly clamped to the top side of the cylinder block and which contains liquid-cooled control parts axially delimiting the working space on one side and channels for the working medium and the cooling medium that are sealed off with respect to each other; the cylinder head thereby includes a bottom plate and side walls and possibly partition walls and the like which act reinforcingly on the bottom plate, whereby the elastic yieldingness of the bottom plate is constructed as uniformly hard as possible within the area of the circumferential configuration of the cylinder liner by weakening the reinforcing action of these walls within certain areas.

29 Claims, 3 Drawing Figures

ENGINE CYLINDER BLOCK AND HEAD CONNECTION

The present invention relates to a reciprocating piston internal combustion engine with at least one cylindrical working space radially delimited by a cylinder liner contained in a cylinder block and with at least one cylinder head which is sealingly clamped to the top side of the cylinder block, axially delimits on one side the working space or spaces and contains the liquid-cooled control parts and which is provided with various mutually separate channels for the working medium and the cooling medium, whereby the cylinder head is equipped with a bottom plate forming a component of the cylinder head and with lateral and possibly partition walls, bolt pipes or the like (reinforcing walls) acting reinforcingly on the bottom plate and also forming a component of the cylinder head.

With reciprocating piston engines of this type, especially with internal combustion engines, a reliable sealing has to take place between the cylinder head and the cylinder block in order that liquid medium cannot escape with certainty out of or enter into the working space at the sealing joint and in order that no working medium can thus enter into the cooling water spaces or can be exhausted uselessly. In order to assure a reliable seal, the seal installed into the sealing joint or gap must be pressed-on with a certain minimum surface pressure or minimum pressure per unit area. By reason of the complicated construction of the cylinder head with working medium supply and exhaust channels, inlet and exhaust valves and spark plugs, injection valves or the like, the cylinder head considered as such from a static point of view is a body of non-uniform rigidity or strength and more particularly also at the side facing the sealing joint, i.e., at the so-called cylinder head bottom plate. The cylinder head bottom plate possesses along the extent of the aforementioned reinforcing walls, relatively hard places and in other areas, in contrast thereto, relatively soft yielding places with respect to the surface pressure necessary for the sealing. In order to now achieve the minimum surface pressure necessary for a reliable seal also at these relatively soft places, the cylinder head has to be clamped very strongly onto the cylinder block, and more particularly in such a manner that the surface pressure of the seal is considerably higher at the harder places of the cylinder head than at the softer places. This non-uniform surface pressure resulting from the differing rigidity and strength of the cylinder head conditioned from its construction, is undesirable for the reason that it causes different edge stresses at the cylinder liners of the piston engine, and more particularly independently of whether the cylinder liner is a unitary component of tye cylinder block or whether it is a cast-in cylinder liner or an inserted separate cylinder liner. These edge stresses at the cylinder liners, which differ in the circumferential direction cause corresponding non-uniform deformations at the cylinder liners which may reach non-permissively large deviations of the actual sliding-surface shape from the desired cylinder shape. These non-permissively high deformations cause a poor piston operation and limit the length of life of the engine.

It has already been attempted to compensate the non-uniform surface pressure of the parts adjoining the sealing gap induced by the non-uniform cylinder head rigidity by a corresponding opposite non-uniform rigidity or hardness of the cylinder head seal. Such a construction of the cylinder head seal, however, cannot be manufactured, with economically acceptable manufacturing expenditures, sufficiently accurately as regards the required hardness gradation. This means, the deviation ranges of the measured hardness values at certain selected places of a series manufactured type of seal are non-permissively large. This has as a consequence that in the series manufacture of reciprocating piston engines, a satisfactorily uniform sealing surface pressure and correspondingly a small warping of the cylinder or a uniform warping within permissive limits of the cylinder takes place in individual cases; this also means, however, that in a non-acceptably large number of other cases, the surface pressure remains nonetheless so non-uniform contrary to the aim that the cylinder distortions and warpings are non-permissively large and non-uniform.

It is the aim of the present invention to utilize a novel approach which, with tolerable manufacturing expenditures, results in a sufficiently narrow tolerance width of the individual surface pressure values realized at the different places in the completely assembled condition of the engine of the parts adjoining the sealing gap. The underlying problems are solved according to the present invention in that the elastic yieldingness of the bottom plate is constructed as uniform as possible within the area of the circumferential configuration of the cylinder liner.

The rigidity of the bottom plate can be constructively influenced generally relatively easily and above all can be influenced relatively accurately and a uniform rigidity and elasticity of the bottom plate of the cylinder head within the indicated areas can be adduced by the specific measures—which, according to the knowledge of the applicant, have been overlooked heretofore. A more simple flat seal, which can be manufactured sufficiently accurately with respect to its elastic properties, and which possesses a uniformly distributed compression hardness, can then be used.

The uniform strength or rigidity of the cylinder head bottom plate may be brought about, for example, in that reinforcing walls are arranged within the cylinder head along the entire circumferential configuration of the cylinder liner. This solution therefore resides in rendering also the softer places as hard as the already hard places. However, numerous obstacles oppose this approach for reasons of factual necessity of different, for example, constructive and manufacturing type. For that reason, it is also possible according to another solution of the present invention, to render the hard places as soft as the already soft places. This can take place, for example, in that at those places of the reinforcing walls, at which the same intersect or are tangent to the peripheral configuration of the cylinder liner (cylinder liner intersection or overlap), a weakening place weakening the supporting effect of the reinforcing walls on the bottom place is provided at the reinforcing walls at the root place between the reinforcing wall and the cylinder head bottom plate. The weakening place can be constructed appropriately as a slot extended parallel to the cylinder head bottom plate which may be realized preferably by milling or the like.

For the most part, the cylinder heads of complicated construction are cast and in the raw or unfinished cylinder head castings, the hollow spaces are in communication with the outside at several places by way of openings which as such are functionally not necessary but are required for manufacturing reasons, namely, by way of the so-called core openings. These core openings must be closed off pressure-tight, which customarily takes place by means of parts pressed into the openings. The parts pressed-inn very tightly into the core openings also exert on the cylinder head bottom plate forces distorting or warping the plate. This warping of the cylinder head bottom plate also is disadvantageous as regards the uniformity of the sealing surface pressure because though the bottom plate may be uniformly rigid, it is not flat. In order to avoid an after-finishing of the head bottom plate after the pressing-in of the core opening covers and to obtain nonetheless a good flat head bottom plate, it is recommended to provide weakening places also within the area of the openings for the pressed-in parts within the root of the reinforcing walls.

Reciprocating piston engines, above all internal combustion engines in the commercial vehicle or heavy duty range exist with working spaces arranged closely adjacent one another in an in-line arrangement and preferably delimited radially by inserted cylinder liners and with a separate cylinder head for each working space. With such in-line engines having a small cylinder spacing and with individual cylinder heads, the cylinder head side walls which are disposed transversely to the engine longitudinal or in-line direction, lie within the area where they are tangent to the circumferential contour of the cylinder liners. In this concrete application, the present invention can therefore be realized in that the weakened places are provided at the side walls of the cylinder heads which are disposed transversely to the in-line direction.

Accordingly, it is an object of the present invention to provide a reciprocating piston engine with a cylinder head equipped with a cylinder head bottom plate, which avoids by simple means the aforementioned shortcomings and drawbacks encountered in the prior art.

Another object of the present invention resides in a reciprocating piston internal combustion engine in which a reliable seal is realized between the cylinder head and cylinder block without involving excessively large, non-acceptable expenditures.

A further object of the present invention resides in a reciprocating piston engine with a cylinder head having a head bottom plate, in which the minimum surface pressure necessary for a reliable seal is attained at all places without the occurrence of excessively large surface pressures in other areas.

A still further object of the present invention resides in a reciprocating piston internal combustion engine with a cylinder head in which a warping of the contact surface of the cylinders due to non-uniform surface pressures of the cylinder head seal is effectively avoided.

Another object of the present invention resides in a reciprocating piston internal combustion engine consisting of cylinder block and cylinder head with a seal disposed therebetween, in which excessively large and/or differing edge stresses are avoided particularly within the areas of the cylinders, especially if constituted by cylinder liners.

A further object of the present invention resides in a reciprocating engine of the type described above which not only excels by a good running of the pistons but also by a long length of life of the engine.

A still further object of the present invention resides in a reciprocating piston internal combustion engine in which acceptable manufacturing expenditures will produce a sufficiently uniform surface pressure at the cylinder head seal and which permits the use of a more inexpensive cylinder head seal with equally good or better results.

These and other objects, features and advantages of the present invention will become more apparent from the following description when taken in connection with the accompanying drawings which shows, for purposes of illustration only, one enbodiment in accordance with the present invention, and wherein.

Figure 1:
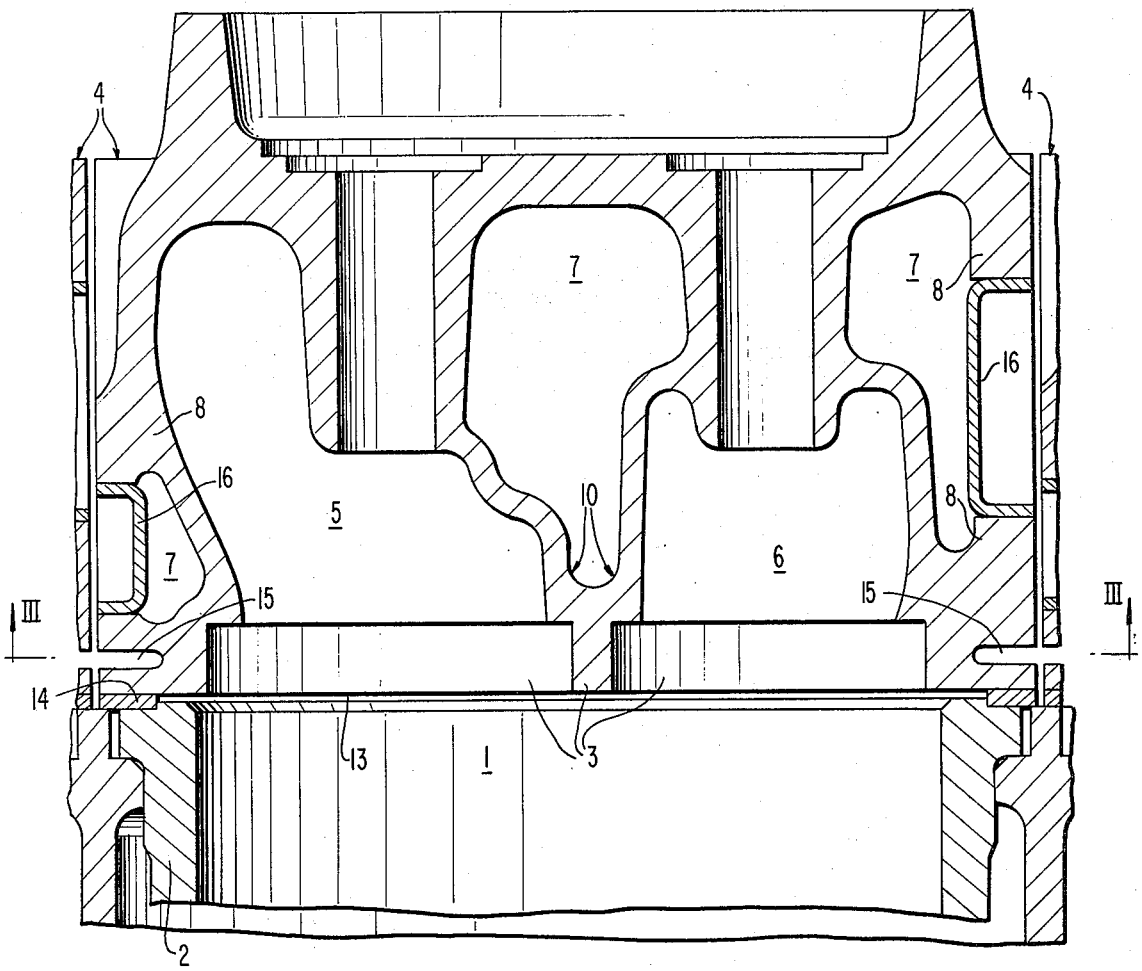
FIG. 1 is a cross-sectional view through an individual cylinder head and the upper portion of the engine block of an in-line engine, taken in the longitudinal direction of the cylinder row along line I—I of FIG. 3.
Figure 2:
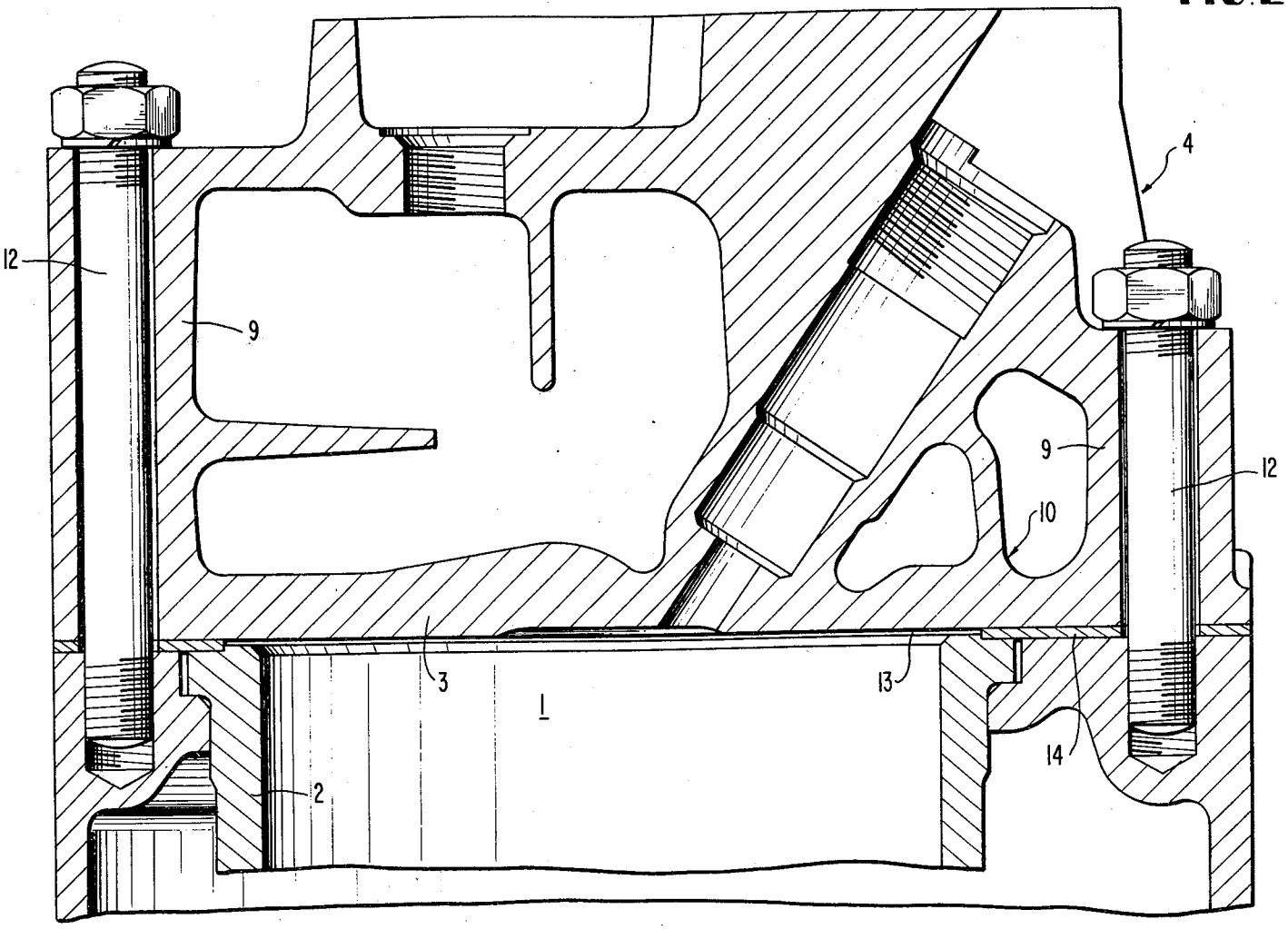
FIG. 2 is a cross-sectional view through the same cylinder head, but taken transversely to the cylinder row, along line II—II of FIG. 3.

Referring now to the drawing wherein like reference numerals are used throughout the various views to designate like parts, in the part of the cylinder head of a reciprocating piston internal combustion engine illustrated in FIGS. 1 and 2, one can recognize the cylinder liner 2 radially delimiting the combustion space 1. In the illustrated embodiment, the cylinder head liner 2 is constructed as a so-called wet, pressed-in liner. The combustion space 1 is delimited on one side in the upward direction by the cylinder head bottom plate 3 of the cylinder head generally designated by reference numeral 4. The cylinder head 4 is constructed as so-called individual head and is therefore provided at the sides of the adjacent cylinder heads with a boundary wall extending transversely to the row or in-line of the cylinders. For purposes of illustrating the supporting parts of the cylinder head, nearly all parts installed or mounted in the cylinder head are omitted in the drawing. Owing to the task of the water-cooled cylinder head to accommodate or form control parts such as, for example, inlet and exhaust valves or different, mutually delimited channels, such as, for example, the suction channel 5, the exhaust channel 6 or the cooling water channel 7, the cylinder head 4 becomes quite complicated on the inside thereof. One therefore has to reckon from the beginning with the fact that the head bottom plate 3 is constructed uniformly rigid everywhere in view of the occurring clamping forces. The cylinder head 4 is delimited externally by vertical side walls which are very rigid and which exert on the bottom plate 3 a reinforcing effect within the area of their transition into the bottom plate 3. Other, vertically disposed elements rectilinearly connecting the top plate of the cylinder head with the bottom plate, for example, the bolt pipes 9 (FIG. 2), also exert a reinforcing effect on the bottom plate because at these places, for example, the rigidity of the side walls is transmitted into the bottom plate by the amount of the pipe width. The rigidity of the top plate could contribute to the rigidity of the bottom plate by such a rectilinear rigid connection between the top and bottom plate. Other transition places 10 of channel boundary walls into the boottom plate 3 contribute only relatively little to the rigidity of the bottom plate because the channel boundary wall, by reason of its configuration, is relatively soft as regards bending stresses.

Figure 3:
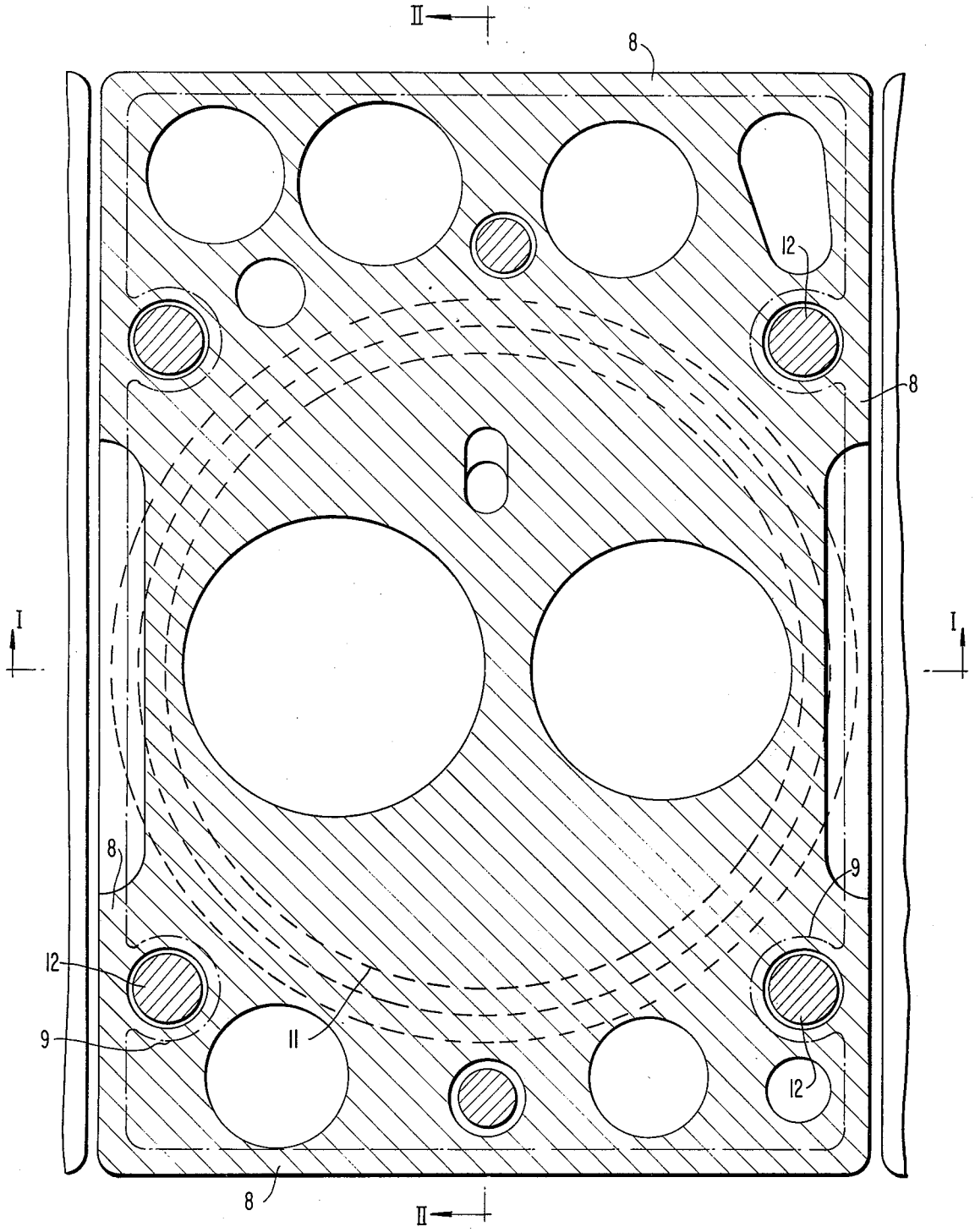
FIG. 3 is a cross-sectional view through the cylinder head bottom plate at the height of the weakening slots, taken along line III—III of FIG. 1.

At the places of overlap of the reinforcing walls with the circumferential configuration 11 of the cylinder liner 2 (FIG. 3) very high abutment forces are therefore exerted by the clamping points 12 onto the edge of the cylinder liner, until the necessary minimum surface pressure values required for a reliable seal at the sealing gap 13 between the cylinder head 4 and the cylinder block are attained in the flat seal 14.

In order to obtain now a bottom plate 3 which is as uniformly rigid or as uniformly strong as possible, the supporting effect of the reinforcing walls 8 onto the bottom plate 3 is reduced in the illustrated embodiment according to the present invention within the area of overlap between the reinforcing walls 8 and the circumferential configuration of the cylinder liner 2 by the provision of a weakened place 15 at the root or base of the reinforcing wall 8. This weakened place 15 is constructed in the form of a slot extending parallel to the bottom plate 3 and extending over the overlap area. By means of this slot the side wall receives within the overlap area a yielding S-shape in the contact portion and the peak pressures are considerably reduced by this yieldingness. A uniform sealing surface pressure and a slight cylinder distortion or warping are the consequences thereof.

In the illustrated embodiment, the core bore openings which are necessary for technical casting reasons and are closed off by so-called core opening covers 16, are also disposed in the side walls facing the adjacent cylinder heads. The relief slot extending underneath and along the core opening cover 16 also serves for the purpose of recuding the enlargements and warpings of the head bottom plate 3 resulting from the pressing-in of the core opening covers 16. The elimination of this warping also contributes to the reduction of the peaks of the surface pressure values and more particularly independently of the fact of whether the core opening covers and accordingly the corresponding relief slots are arranged or are not arranged above an overlap area of reinforcing wall and cylinder liner.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A reciprocating piston engine with at least one cylindrical working space means and with a cylinder head means sealingly clamped onto a cylinder block means, the cylinder head means which axially delimits the working space means, accommodates liquid-cooled control members and contains channel means for the working medium and the cooling medium which are closed off with respect to each other, including a bottom plate means and reinforcing wall means acting reinforcingly on the bottom plate means, the bottom plate means and the reinforcing wall means being components of the cylinder head means, characterized in that the elastic yieldingness of the bottom plate means is constructed as uniformly hard as possible within the area of the circumferential configuration of the cylinder means, and characterized in that at those places of the reinforcing wall means at which the reinforcing wall means either intersect or are tangent to the circumferential configuration of a cylinder means, a weakened place is provided in the reinforcing wall means at the root between the reinforcing wall means and the bottom plate means, which weakens the supporting effect of the reinforcing wall means on the bottom plate means.

2. A reciprocating piston engine according to claim 1, characterized in that the working space means is radially delimited by a cylinder liner contained in the cylinder block means.

3. A reciprocating piston engine according to claim 2, characterized in that the reinforcing wall means include lateral walls.

4. A reciprocating piston engine according to claim 3, characterized in that said reinforcing wall means include also partition walls and bolt pipes.

5. A reciprocating piston engine according to claim 4, characterized in that reinforcing wall means are arranged in the cylinder head means substantially along the entire circumferential configuration of the cylinder liner of the cylinder means.

6. A reciprocating piston engine according to claim 5, characterized in that the weakened place is constructed as a slot extending substantially parallel to the bottom plate means.

7. A reciprocating piston engine according to claim 5, with members pressed into aperture means into the reinforcing wall means, characterized in that corresponding weakened places are provided also within the root of the reinforcing wall means within the area of the aperture means for the pressed-in parts.

8. A reciprocating piston engine according to claim 7, characterized in that said pressed-in parts form core bore covers.

9. A reciprocating piston engine according to claim 7, characterized in that the weakened place is constructed as milled-in slot.

10. A reciprocating piston engine according to claim 8, with an in-line arrangement of working space means closely adjacent one another and with separate cylinder head means for each working space means, characterized in that the weakened places are provided at the side walls of the cylinder head means disposed transversely to the in-line direction.

11. A reciprocating piston engine according to claim 9, characterized in that the working space means are radially delimited by inserted cylinder liners.

12. A reciprocating piston engine according to claim 10, characterized in that the engine is an internal combustion engine.

13. A reciprocating piston engine according to claim 1, characterized in that the weakened place is constructed as a slot extending substantially parallel to the bottom plate means.

14. A reciprocating piston engine according to claim 1, with members pressed into aperture means into the reinforcing wall means, characterized in that corresponding weakened places are provided also within the root of the reinforcing wall means within the area of the aperture means for the pressed-in parts.

15. A reciprocating piston engine according to claim 1, characterized in that the weakened place is constructed as milled-in slot.

16. A reciprocating piston engine according to claim 1, with an in-line arrangement of working space means closely adjacent one another and with separate cylinder head means for each working space means, characterized in that the weakened places are provided at the side walls of the cylinder head means disposed transversely to the in-line direction.

17. A reciprocating piston engine according to claim 16, characterized in that the working space means are radially delimited by inserted cylinder liners.

18. A reciprocating piston engine with at least one cylindrical working space means and with a cylinder head means sealingly clamped onto a cylinder block means, the cylinder head means which axially delimits the working space means, accommodates liquid-cooled control members and contains channel means for the working medium and the cooling medium which are closed off with respect to each other, including a bottom plate means and reinforcing wall means acting reinforcingly on the bottom plate means, the bottom plate means and the reinforcing wall means being components of the cylinder head means, characterized in that the elastic yieldingness of the bottom plate means is constructed as uniformly hard as possible within the area of the circumferential configuration of the cylinder means, and with members pressed into aperture means into the reinforcing wall means, characterized in that weakened places are provided within the root of the reinforcing wall means within the area of the aperture means for the pressed-in parts.

19. A reciprocating piston engine according to claim 18, characterized in that the weakened place is constructed as a slot extending substantially parallel to the bottom plate means.

20. A reciprocating piston engine according to claim 18, characterized in that reinforcing wall means are arranged in the cylinder head means substantially along the entire circumferential configuration of the cylinder liner of the cylinder means.

21. A reciprocating piston engine with at least one cylindrical working space means in a cylinder block means and with a cylinder head means sealingly clamped onto said cylinder block means for axially delimiting the working space means; wherein said cylinder head means includes:

channel means for a working medium and a cooling medium which are closed off with respect to one another, bottom plate means clampingly engageable with seal means at said cylinder block means along sealing plate surface portions of said bottom plate means, and reinforcing wall means acting reinforcingly on the bottom plate means, wherein intentional structural modifications are provided in said cylinder head means adjacent said sealing plate surface portions, which structural modifications provide a substantially uniform elastic yieldingness of the bottom plate means along said sealing plate surface portions, whereby sealing means of uniform characteristics along said sealing plate surface portions can be utilized.

22. A reciprocating piston engine according to claim 21, characterized in that at those places of the reinforcing wall means at which the reinforcing wall means either intersect or are tangent to the circumferential configuration of a cylinder liner forming the cylinder means, a weakened place is provided in the reinforcing wall means at the root between the reinforcing wall means and the bottom plate means, which weakens the supporting effect of the reinforcing wall means on the bottom plate means.

23. A reciprocating piston engine according to claim 21, wherein said sealing means if formed separately of said cylinder head means and said cylinder block means.

24. A reciprocating piston engine according to claim 23, wherein said structural modifications include weakened places formed in the reinforcing wall means, which weaken the supporting effect of the reinforcing wall means on the bottom plate means.

25. A reciprocating piston engine according to claim 24, wherein said weakened places are formed at a root portion between the reinforcing wall means and the bottom plate means.

26. A reciprocating piston engine according to claim 24, wherein said weakened places are formed by milled-slot means.

27. A reciprocating piston engine according to claim 24, wherein said sealing means is formed separately of said cylinder head means and said cylinder block means.

28. A reciprocating piston engine according to claim 24, wherein the weakened places are constructed as slot means extending substantially parallel to the bottom plate means.

29. A reciprocating piston engine according to claim 28, wherein core opening cover members are pressed into core aperture means of the reinforcing wall means, and wherein said weakened places are formed adjacent the bottom plate means within the area of said aperture means.

* * * * *